US005349705A

United States Patent [19]

Ragan

[11] Patent Number: 5,349,705

[45] Date of Patent: Sep. 27, 1994

[54] FIREFIGHTER'S GLOVE AND METHOD OF MANUFACTURE

[75] Inventor: Thomas G. Ragan, Germantown, Tenn.

[73] Assignee: Shelby Group International Inc., Memphis, Tenn.

[21] Appl. No.: 729,720

[22] Filed: Jul. 12, 1991

[51] Int. Cl.[5] ..... A41D 19/00

[52] U.S. Cl. ..... 2/161.6; 2/164; 2/169

[58] Field of Search ..... 2/163, 164, 169, 2, 2/161.6, 159

[56] References Cited

U.S. PATENT DOCUMENTS

| | | | |
|---|---|---|---|
| 1,252,900 | 1/1918 | Grinnell | 2/169 |
| 2,194,934 | 3/1940 | Geissmann | 2/169 |
| 3,098,237 | 7/1963 | Slimovitz | 2/164 |
| 3,114,915 | 12/1963 | Gross | 2/158 |
| 4,197,592 | 4/1980 | Klein | 2/161 |
| 4,355,424 | 10/1982 | McCoy, Jr. | 2/161 R |
| 4,430,759 | 2/1984 | Jackrel | 2/159 |
| 4,545,841 | 10/1985 | Jackrel | 156/290 |
| 4,583,248 | 4/1986 | Edwards et al. | 2/164 |
| 4,679,257 | 7/1987 | Town | 2/164 |
| 4,733,413 | 3/1988 | Dykstra | 2/164 X |
| 4,847,918 | 7/1989 | Sturm | 2/161 R |
| 4,918,756 | 4/1990 | Grilliot et al. | 2/164 |
| 5,020,161 | 6/1991 | Lewis, Jr. et al. | 2/164 |
| 5,123,119 | 6/1992 | Dube | 2/169 X |

FOREIGN PATENT DOCUMENTS

| | | | |
|---|---|---|---|
| 3922598 | 1/1991 | Fed. Rep. of Germany | 2/164 |
| 2215179 | 1/1973 | France . | |

*Primary Examiner*—Clifford D. Crowder

*Assistant Examiner*—Sara M. Current

*Attorney, Agent, or Firm*—Woodcock Washburn Kurtz Mackiewicz & Norris

[57] ABSTRACT

A multi-layer waterproof fireman's glove is disclosed. The inner liner of the glove is sewn to a moisture barrier layer in an inside/out position at tip extension portions that extend from the moisture barrier. The tip extension portions are formed beyond a line of sealing in the moisture barrier layer. The location of the stitches on the moisture barrier layer is thus outside the sealed region surrounding the hand. The moisture barrier layer is then reversed back over the inner liner such that it overlies the inner liner and attachment tabs are applied at each of the fingertips. The attachment tabs are then sewn to the exterior glove layer, which is in an inside/out position during attachment. The exterior glove layer is then reversed back over the moisture barrier/inner liner combination. As a result, in a preferred embodiment three layers of the glove are firmly affixed together while avoiding the use of glue, yet none of the stitches puncture the sealed portion of the moisture barrier layer that surrounds the hand. In an alternate embodiment, the attachment tabs connect the inner liner and the moisture barrier layer, while the tip extensions are attached to the exterior glove layer. In an alternate embodiment the attachment tabs affix the inner liner to the moisture barrier layer. When the moisture barrier layer is reversed to overlie the inner liner, the tip extensions are exposed and used to attach the moisture barrier layer to the exterior glove layer. In certain embodiments, the material of the moisture barrier layer is comprised of a material that is resistant to one or more types of hazardous chemicals.

18 Claims, 3 Drawing Sheets

FIREFIGHTER'S GLOVE AND METHOD OF MANUFACTURE

The present invention relates to glove construction and more particularly relates to the construction of gloves having an outer covering which is heat resistant and an inner structure having insulating and moisture resistant layers.

BACKGROUND OF THE INVENTION

The specialized gloves worn by firemen must exhibit a number of features in order to adequately perform in the hazardous environments encountered during use. First, the outermost shell or layer of the glove must be of a tough, abrasion-resistant, preferably heat-resistant material that shields the hand from heat and permits any gripping or grasping that might be required. Inside this outer layer a moisture barrier is also typically provided to prevent the firefighter's hands and any intervening layers within the glove from being soaked with water. Finally, it is ordinarily desirable to include an inner layer comprised of a soft material that is preferably both heat-resistant and provides a degree of padding for the glove. Similar specialized gloves are worn by a variety of users who need to provide multiple types of protection for their hands and who typically achieve such protection using a glove wherein at least one layer is a moisture barrier layer.

U.S. Pat. No. 4,918,756—Grilliot et al. discloses a firefighter's glove exhibiting the above-described sequence of layers. The moisture resistant layer is attached to a thermal barrier layer by stitching across the tip of the finger portion of the glove. A sealing piece covers the stitches used to attach these layers and provides sealing of the holes created in the moisture resistant layer by the stitches. The sealing piece, which is in the form of a tab, also provides a location where the outer layer is attached to the inner glove structure.

U.S. Pat. No. 4,679,257—Town also discloses a waterproof glove having an insulating layer, a waterproof layer and an outer layer. A fingertip tab is connected at one end to the inner layer, passes through and is stitched to the intermediate waterproof layer, and by extending beyond the intermediate waterproof layer provides a tab to which the outer layer may be stitched.

A fire retardant and heat insulating glove is disclosed in U.S. Pat. No. 4,847,918—Sturm. This patent discloses that the heat insulating inner layer is cemented by adhesive to a moisture resistant layer. A flexible reinforcement element is affixed to the outside of a moisture resistant layer that has finger portions somewhat longer than the fingers of the moisture resistant layer. Preferably the reinforcement layer is cemented to one face of the moisture resistant layer and its extensions beyond the fingertips provide locations for securing the outer layer to the rest of the glove structure.

Despite these advances in the art, it has been found that most of the types of glue used to affix various portions of such gloves together such as disclosed by Strum do not provide adequate structural integrity after repeated soakings and permit the layers to separate. Gloves assembled using adhesive over large portions of their surface areas are also inherently less compliant than other glove structures. Moreover, in the above-described patents to Grilliot et al. and Town, the tips of the moisture barrier layer and the insulating inner layer are sewn together such that the moisture barrier is punctured. Thus, there remains a need to provide a glove construction which avoids the use of glue to attach the layers of the glove together, but avoids any puncturing of the moisture barrier layer by the stitches which affix the layers of the glove together.

SUMMARY OF THE INVENTION

In accordance with one embodiment of the present invention, an inner liner of a glove is sewn to a moisture barrier layer at tip extension portions extending from the moisture barrier. The tip extension portions are formed beyond a line of sealing that extends around the periphery of the moisture barrier layer. The location of the stitches on the moisture barrier layer is thus outside the sealed region surrounding the hand. The moisture barrier layer is then reversed back over the inner liner such that it overlies the inner liner and attachment tabs are applied at each of the fingertips. The attachment tabs are then sewn to the exterior glove layer, which is in an inside/out position during attachment. The exterior glove layer is then reversed back over the moisture barrier/inner liner combination. As a result, the three layers of the glove are firmly affixed together while avoiding the use of glue, yet none of the stitches puncture the sealed portion of the moisture barrier layer that surrounds the hand.

In an alternate embodiment of the present invention an attachment tab is affixed to the moisture barrier layer while it is in an inside/out position and the inner liner is attached to the tabs. The moisture barrier layer is then reversed over the inner liner, exposing the tip extension portions. The outer glove layer is then attached to the tip extensions in an inside/out position and reversed over the moisture barrier layer. As with the first described embodiment, a three layer glove in which the intermediate waterproof layer has not been punctured is produced.

DETAILED DESCRIPTION OF THE PREFERRED EMBODIMENTS

Figure 1:
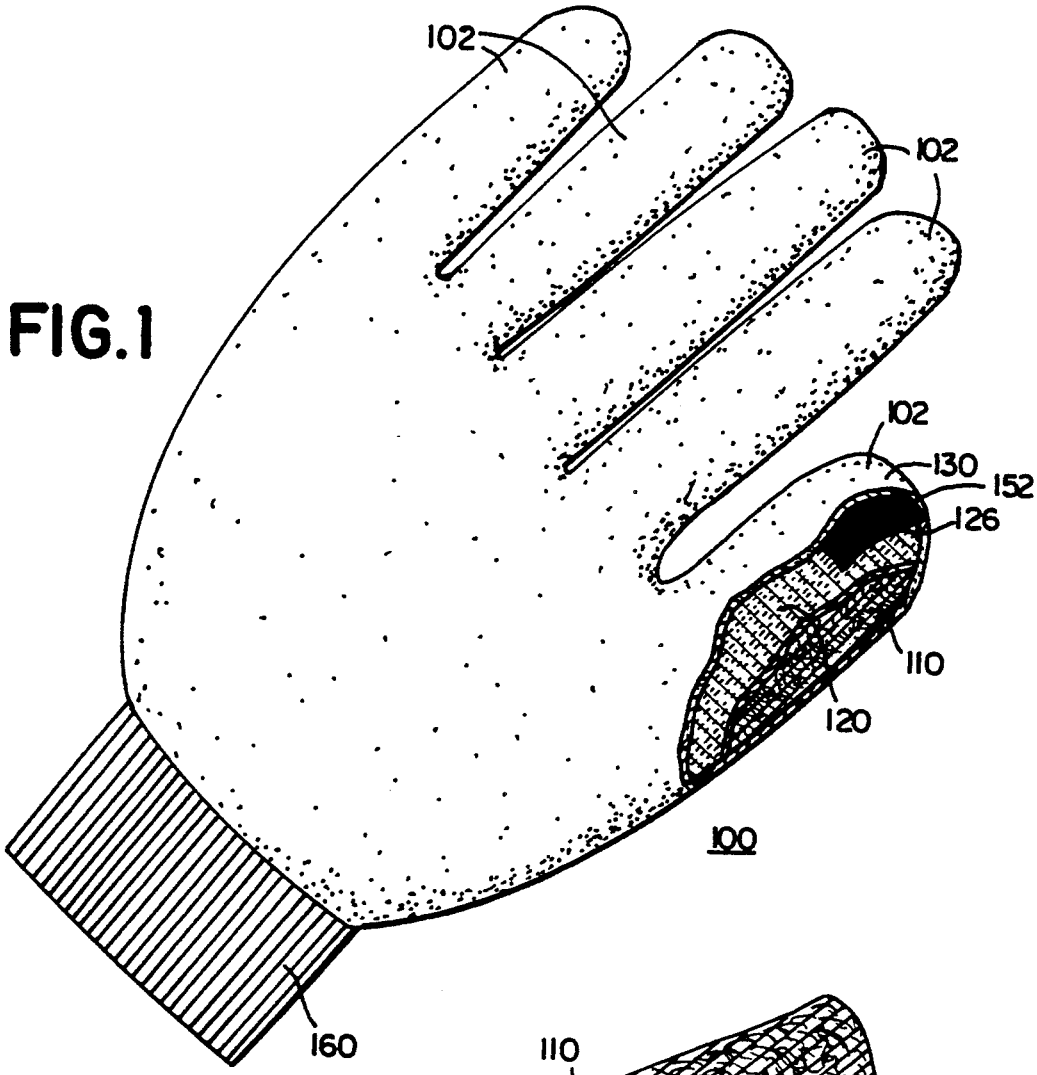
FIG. 1 is a plan view, partially cut away showing the construction of a glove made in accordance with the present invention.

Referring now to FIG. 1, there is shown a glove 100 made in accordance with the present invention. As illustrated, the glove is preferably of the type having four fingers 102 and a thumb 102. However, in certain instances and in alternate embodiments of the present invention it may be desirable to create a glove 100 having other numbers of fingers 102. It will be understood that reference to a "finger" or "fingertip" includes any of the fingers 102, including the thumb 102. Also, although the glove 100 illustrated is for the left hand, it will be realized that a right hand glove 100 would form a pair of gloves in accordance with the present invention. In a preferred embodiment illustrated, the glove 100 has a cuff or wristlet 160 attached near the wrist portion of the wearer. In other embodiments, this feature may be deleted, or be replaced by straps, buckles, or other fasteners to help insure a seal of some degree between the wrist or arm of the wearer and the glove 100 of the present invention. Those of ordinary skill will appreciate that gloves made in accordance with the present invention can extend for any length down the user's arm, from the shorter glove 100 illustrated in FIG. 1, that ends at about the wrist of the wearer to long gauntlets or other constructions which integrate a glove 100 section with another garment.

As illustrated in the broken away portion of FIG. 1, the glove 100 of the present invention is preferably comprised of an inner layer 110 over which lies a moisture barrier layer 120, that is in turn covered by an exterior glove layer 130. In a preferred embodiment of the present invention, the exterior glove layer 130 is preferably comprised of leather, although canvas or other abrasion resistant materials or any other suitable material that will offer the required protection in extreme conditions may be used in other embodiments. Also visible in FIG. 1 is a portion of an attachment tab 126 that is affixed to the moisture barrier layer 120 near the distal end of each of the finger portions 102 of the glove 100. As explained in further detail below, this attachment tab 126 permits the outer glove portion 130 to be attached to the moisture barrier layer 120 by stitches 152 that do not puncture the moisture barrier 120.

Figure 2:
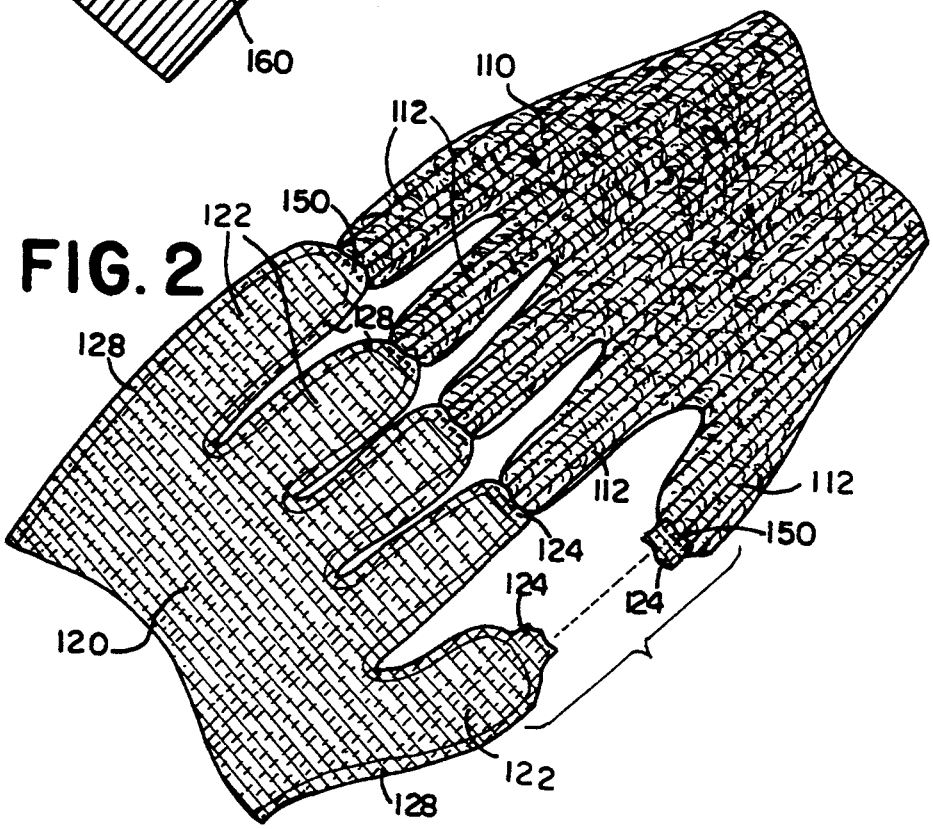
FIG. 2 is a plan view showing the attachment of the inner liner and moisture barrier in a glove made in accordance with the present invention.
Figure 3:
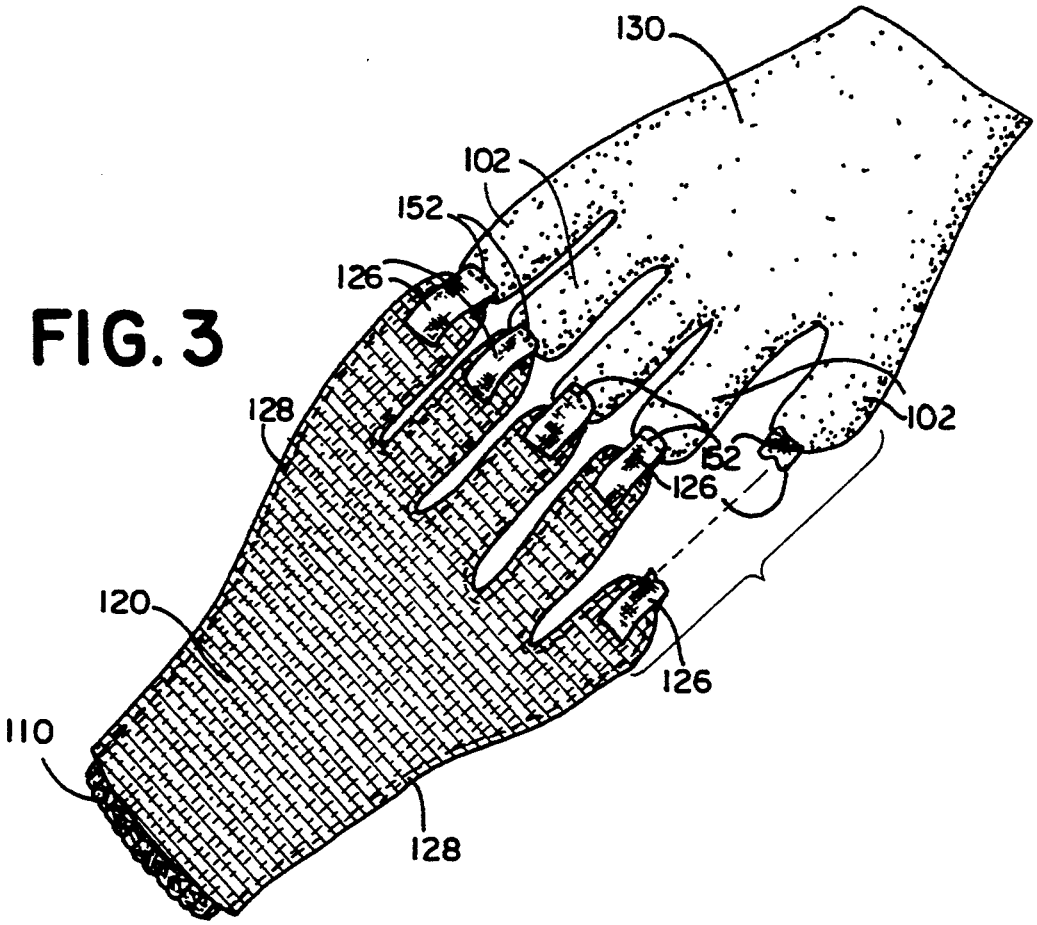
FIG. 3 is a plan view showing the attachment of the exterior glove layer to the moisture barrier layer in a glove made in accordance with the present invention.

The internal construction of the glove 100 illustrated in FIG. 1 can be better explained by referring to FIGS. 2–3 which illustrate both the structure of the glove 100, and certain aspects of its assembly. Referring to FIG. 2, an inner layer 110 is provided that is preferably comprised of a knitted or woven material such as wool, polyethylene or any of the numerous man-made fibers suitable for this purpose. In certain instances, it will be desirable to provide an inner layer 110 that is formed from flame resistant or flame retardant knit materials. As is also seen in FIG. 2, a substantially glove-shaped moisture barrier layer 120 is provided which has a peripheral seal or seam 128 formed about the sides and fingertip portions 122 of the moisture barrier layer 120. Integrally formed in the moisture barrier layer 120 are fingertip extension portions 124 that are an extension of the portion of the moisture barrier layer 120 that lies beyond the peripheral seal 128. Thus, any punctures or damage made to the extension portions 124 or to other similar regions lying outside the edge of the peripheral seal 128 do not violate or destroy the moisture resisting capability of the moisture barrier layer 120.

The moisture barrier layer 120 may either be comprised of a material that is completely water repellent such as a polyethylene, microporous polyether urethane or PTFE (Teflon TM) film or may be comprised of a material that is impervious to liquid but permeable to water vapor such that perspiration from the hands may escape through the inner liner 110, through the moisture barrier layer 120 and to the outside of the glove. Alternately, in certain embodiments the moisture barrier layer 120 may be comprised of a layer that is treated merely to be water resistant or water repellent, but which will not truly render the glove waterproof. In certain embodiments, the material chosen for the moisture barrier layer will also serve as a barrier to one or more types of hazardous chemicals, such as caustic solutions, solvents, dyes, industrial wastes and the like. As known to those of ordinary skill, certain moisture barrier materials are more resistive to particular classes of hazardous chemicals than others. The choice of a moisture barrier material will therefore depend upon the anticipated types of chemicals to which the user will be exposed. Thus, as used herein, the term "moisture barrier layer" includes materials that are resistant to one or more types of hazardous chemicals. The choice of materials for this layer, and the other layers are design considerations well known to those of ordinary skill depending on the desired cost of the glove, the ultimate anticipated end use and the preference of the user.

Referring still to FIG. 2, it will be seen that the extension portions 124 are attached to the fingertip portions of the inner liner 110 by stitches 150. For purposes of illustration the thumb portions are shown detached but connected by a dotted line and the extension portion 124 of the thumb is shown connected to the thumb of the inner liner 110. In actuality, all of the fingertips, whatever their number may be, are connected and the moisture barrier layer 120 is then reversed over the inner liner 110 such that it overlies the inner knit liner 110 and the stitches 150 are now covered over by the unbroken sealed portion of the moisture barrier layer 120. As shown in FIG. 3, the combined structure of the inner liner 110 and moisture barrier layer 120 is affixed to the exterior glove layer 130 by a second set of stitches 152. However, in accordance with the present invention in order to prevent any puncturing of the moisture barrier layer 120, attachment tabs 126 are preferably affixed near the distal end of each of the finger portions 122 of the moisture barrier layer 120. The attachment tabs 126 are preferably comprised of adhesive tape, but may be comprised of any of a number of materials such as strips of cloth or plastic affixed to the moisture barrier layer 120 either by an adhesive, heat sealing or any other method that permits them to be attached without puncturing the moisture barrier layer 120. The structure illustrated in FIG. 3 is finished by overturning the exterior glove layer 130 so that its outer surface now faces out and its inner surface overlies the moisture barrier layer 120. The completed glove structure may then be affixed to a cuff or wristlet 160, as illustrated in FIG. 1, or as explained above may be affixed to a longer gauntlet portion or to another garment.

Figure 4A:
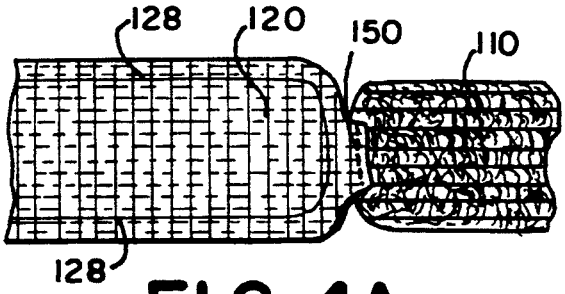
FIGS. 4A–4D are a series of plan views of the fingertip portion of a single finger of a glove made in accordance with the present invention showing various stages of construction undertaken when constructing gloves in accordance with the methods of the present invention.
Figure 4B:
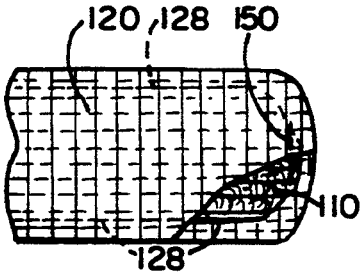
Figure 4C:
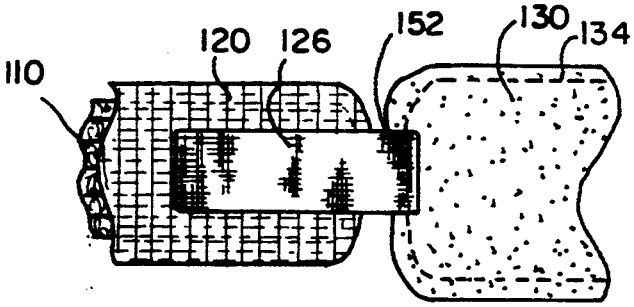
Figure 4D:
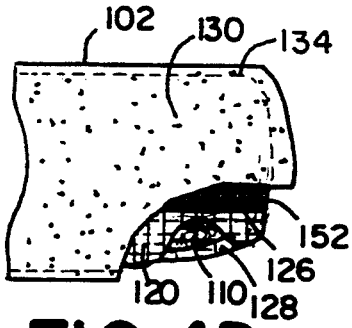

In order to better illustrate the methods of the present invention, a portion of a single fingertip 102 of a glove 100 made in accordance with the embodiment of the present invention illustrated in FIGS. 1–3 is illustrated in FIGS. 4A–4D. First, an inner liner 110 and a moisture barrier layer 120 are attached by stitches 150 that pass through the tip extension portion 124 of the moisture barrier layer 120. As explained above and again illustrated, the moisture barrier layer 120 is provided with a seal 128 and the tip extension portion 124. The stitches 150 passing through the tip extension portion 124 are thus outside the boundary of the seal 128, leaving the interior portion of the moisture barrier layer 120 unpunctured. Turning to FIG. 4B the fingertip portion 102 is shown partially cut away to illustrate the location of the seal 128 relative to the stitches 150. As illustrated in FIG. 4C the structure illustrated in FIG. 4B is affixed to the exterior glove layer 130 by an attachment tab 126 that is affixed to the moisture barrier layer 120 and stitched to the exterior glove layer 130 using stitches 152. Also visible in FIG. 4C are the exterior glove layer stitches 134 typically found in gloves constructed of leather or other durable abrasion-resistant and heat-resistant materials. The final, finished stage of the construction of the glove of the present invention is illustrated in FIG. 4D, which is partially broken away to show the interior structure of the fingertip 102. In this view, stitches 152 that join the outer glove layer 130 and the moisture barrier layer 120 are visible, as are the outer glove layer edge stitches 134. Also visible in the cut away portion is the position of the seal 128 of the moisture barrier layer 120 and the location of the inner liner 110.

An alternate embodiment of the present invention and of its method of construction is illustrated in FIGS. 5A–5D. Those of ordinary skill will appreciate that the overall structure of this embodiment of the present invention is similar to that illustrated in FIGS. 1–3, except for the details described immediately below.

Figure 5B:
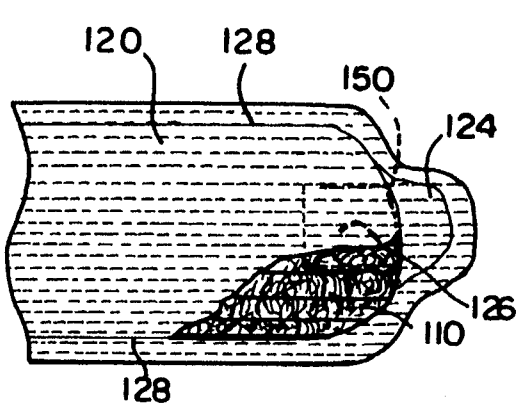
FIGS. 5A–5D are a series of plan views of the fingertip portion of a single finger of another embodiment of a glove made in accordance with the present invention showing various stages of construction undertaken when constructing gloves in accordance with the methods of the present invention.
Figure 5D:
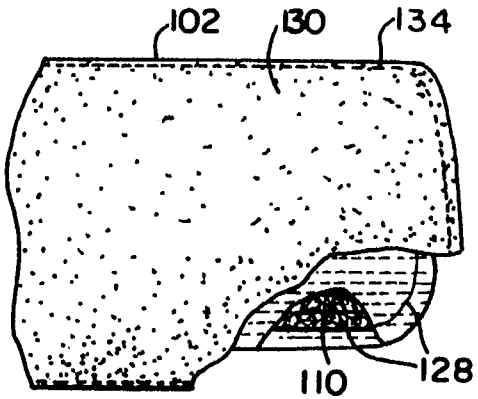
Figure 5A:
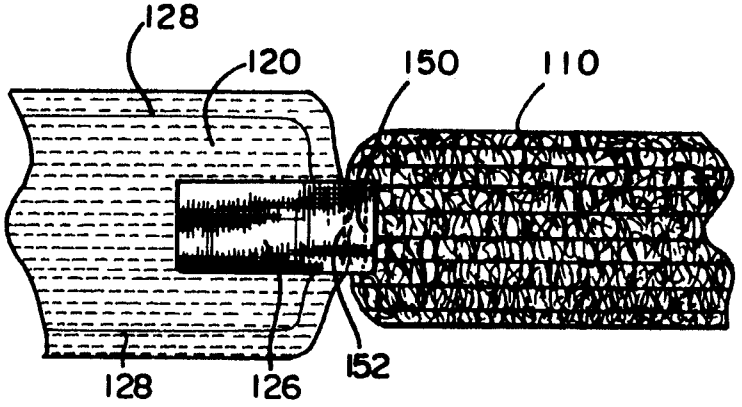
Figure 5C:
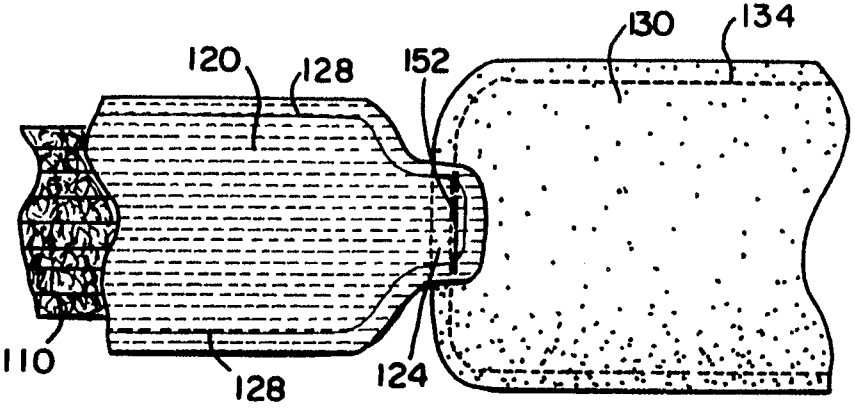

As shown in FIG. 5A, the moisture barrier layer 120 is first positioned so that the fingertip extension portions 124 is on the inside. An attachment tab 126 is then affixed to the exposed inside surface of the moisture barrier layer 120, as explained above. However, in this embodiment, the stitches 150 that affix the inner layer 110 to the moisture barrier layer 120 are sewn through the attachment tab 126. The moisture barrier layer 120 is then reversed over the inner layer 110, as seen in FIG. 5B, exposing the tip extension portion 124. Next, the tip extension portion 124 is attached to the exterior glove layer 130 by stitches 152. Finally, the exterior glove layer is reversed over the moisture barrier layer 120, resulting in a three layer glove construction as described above with reference to FIG. 1.

The embodiment of the present invention illustrated in FIGS. 5A–5D differs from that illustrated in FIGS. 4A–4D largely in the relative placement and attachment of the layers via the tip extensions 124 and the attachment tabs 126. One advantage of the embodiment illustrated in FIGS. 5A–5D is that the attachment tabs 126 are beneath the moisture barrier layer 120 relative to the exterior of the glove 100. This feature is desirable if the tabs 126 are affixed using an adhesive. However, both embodiments of the present invention provide gloves having points of attachment that do not require puncturing the moisture barrier layer 120 inside of the seal 128. Thus, the present invention as illustrated and described above solves a problem suffered by prior art gloves wherein the moisture barrier layer was punctured or otherwise violated by the means for attaching the various layers of the glove together, resulting in a need for these puncture areas to be sealed against the intrusion of moisture. The present invention, on the other hand, provides a completely sealed and, if desired, completely water impervious intermediate moisture barrier layer which, although firmly attached to the inner liner using stitches and additionally firmly attached to the outer glove layer using stitches, does not require that any of either of these sets of stitches penetrate the portion of the moisture barrier layer lying within a peripheral seal extending around the moisture barrier layer thus keeping moisture from contacting the hand of the wearer.

Although certain embodiments of the present invention have been set forth above with particularity, those of ordinary skill will appreciate that numerous variations, adaptations or modifications to the embodiment disclosed and to the methods disclosed above are possible. For example the materials used in the gloves of the present invention, the number of fingers, the exact location and types of stitching and other aspects of the glove construction can be altered while still embodying the spirit of the present invention. Accordingly, reference should be made to the appended claims in order to determine the true scope of the present invention.

What is claimed is:

1. A multi-layer glove comprising:

a substantially glove-shaped exterior glove layer for protecting the hand, the exterior glove layer having a plurality of finger portions;

a substantially glove-shaped moisture barrier layer having inner and outer surfaces and a plurality of finger portions, the moisture barrier layer further comprising: (1) a seal disposed around its periphery; and (2) integral extension portions extending outwardly from the seal, the extension portions being located in a distal end of each finger portion, wherein the moisture barrier layer is attached to the exterior glove layer by first stitches;

a substantially glove-shaped inner liner having a plurality of finger portions attached by second stitches to the moisture barrier layer; and attachment means overlying the moisture barrier layer and affixed thereto by an adhesive bond, wherein one of the first and second stitches penetrates through the attachment means without puncturing the moisture barrier layer, and wherein the other of the first and second stitches only punctures the moisture barrier layer in the integral extension portions.

2. The glove of claim 1, wherein the exterior glove layer is attached to the moisture barrier layer by stitches extending through the integral extension portions and the moisture barrier layer is attached to the inner liner by stitches extending through the attachment means.

3. The glove of claim 1, wherein the exterior glove layer is attached to the moisture barrier layer by stitches extending through the attachment means and the moisture barrier layer is attached to the inner liner by stitches extending through the integral extension portions.

4. The glove of claim 1, wherein the exterior glove layer is comprised of leather.

5. The glove of claim 1, wherein the moisture barrier layer is comprised of a material that is water impervious and resistant to penetration by hazardous chemicals.

6. The glove of claim 1, wherein the moisture barrier layer is comprised of a material that is water vapor permeable, wherein perspiration from the wearer's hand is permitted to pass through the moisture barrier layer.

7. The glove of claim 1, wherein the moisture barrier layer is comprised of a water repellent material.

8. The glove of claim 1, wherein the inner liner is comprised of a woven material.

9. The glove of claim 8 wherein the woven material is flame resistant.

10. The glove of claim 1, further comprising a wristlet portion affixed to the glove to provide a seal between the glove and a wearer's wrist.

11. A method for producing a multi-layer glove comprising the steps of:

providing a (1) glove-shaped exterior glove layer, (2) a moisture barrier layer having a peripheral seal and extension portions extending outwardly from the seal, and (3) an inner liner, each having an outer surface, an inner surface and a plurality of finger portions;

attaching the inner liner to the moisture barrier layer by stitching through the moisture barrier layer only in the extension portions extending outwardly from the peripheral seal of the moisture barrier layer, whereby the glove-shaped portion of the moisture barrier layer remains unpunctured;

reversing the moisture barrier layer to overlie the inner liner;

affixing attachment tabs to the moisture barrier layer using an adhesive bond, the tabs overlying the finger portions of the outer surface of the moisture barrier layer; and attaching the finger portions of the outer glove layer to the attachment means by stitching, whereby the glove-shaped portion of the moisture barrier layer remains unpunctured.

12. The method of claim 11, wherein the step of affixing attachment tabs comprises applying strips of adhesive tape to the finger portions.

13. The method of claim 11, wherein the step of affixing attachment tabs comprises applying strips of material to the finger portions using a water impervious adhesive.

14. The method of claim 11, wherein the steps of attaching comprises stitching at least two of the layers together.

15. A method for producing a multi-layer glove comprising the steps of:

providing (1) a glove-shaped exterior glove layer, (2) a moisture barrier layer having a peripheral seal and extension portions extending outwardly from the seal, and (3) an inner liner, each having an outer surface, an inner surface and a plurality of finger portions;

reversing the moisture barrier layer to place the inner surface thereof on the outside;

affixing attachment tabs to the finger portions of the inner surface of the moisture barrier layer;

attaching the inner liner to the attachment tabs, whereby the glove-shaped portion of the moisture barrier layer remains unpunctured;

reversing the moisture barrier layer to overlie the inner layer; and attaching the finger portions of the exterior glove layer to the extension portions of the moisture barrier layer, whereby the glove-shaped portion of the moisture barrier layer remains unpunctured.

16. The method of claim 15, wherein the step of affixing attachment tabs comprises applying strips of adhesive tape to the finger portions.

17. The method of claim 15, wherein the step of affixing attachment tabs comprises applying strips of material to the finger portions using a water impervious adhesive.

18. The method of claim 15 wherein the steps of attaching comprises stitching at least two of the layers together.

* * * * *